US006109395A

United States Patent [19]

Storm

[11] Patent Number: 6,109,395

[45] Date of Patent: Aug. 29, 2000

[54] CONVERTIBLE LIFT MECHANISM HAVING A SCISSOR LIFT LINKAGE

[75] Inventor: George Lawrence Storm, Trotwood, Ohio

[73] Assignee: Vertical Mobility, LLC, Dayton, Ohio

[21] Appl. No.: 09/114,774

[22] Filed: Jul. 14, 1998

Related U.S. Application Data

[60] Provisional application No. 60/052,474, Jul. 14, 1997.

[51] Int. Cl.[7] ..... B66B 9/08

[52] U.S. Cl. ..... 187/200; 414/545

[58] Field of Search ..... 187/200, 201, 187/269, 240; 414/545, 921; 280/166; 254/120, 122

[56] References Cited

U.S. PATENT DOCUMENTS

| | | | |
|---|---|---|---|
| 4,124,097 | 11/1978 | Hawks et al. | 187/9 R |
| 4,164,292 | 8/1979 | Karkau | 414/545 |
| 4,168,134 | 9/1979 | Pohl | 414/545 |
| 4,180,366 | 12/1979 | Roth et al. | 414/540 |
| 4,270,630 | 6/1981 | Karkau | 187/9 R |
| 4,273,217 | 6/1981 | Kajita | 187/9 R |
| 4,285,416 | 8/1981 | Dudynskyj | 187/9 R |
| 4,457,402 | 7/1984 | Del Vecchio et al. | 187/200 |
| 4,583,466 | 4/1986 | Reddy et al. | 105/447 |
| 4,941,797 | 7/1990 | Smillie, III | 187/269 |
| 5,224,723 | 7/1993 | Hatas | 280/166 |

FOREIGN PATENT DOCUMENTS 404095538 3/1992 Japan .

*Primary Examiner*—Kenneth W. Noland
*Attorney, Agent, or Firm*—Maginot, Addison & Moore

[57] ABSTRACT

A convertible lift mechanism lifts a person or an object from a first surface to a vertically displaced second surface. The convertible lift mechanism includes a source of motive force, a scissor lift linkage, and a conversion stair. The conversion stair has a first configuration in which it functions as a stair and a second configuration in which it functions as at least a portion of a lift platform. When the conversion stair is in the first configuration, the convertible lift mechanism functions as a stairway. When the conversion stair is in the second configuration, the convertible lift mechanism functions as a platform lift or wheelchair lift.

17 Claims, 8 Drawing Sheets

CONVERTIBLE LIFT MECHANISM HAVING A SCISSOR LIFT LINKAGE

CROSS REFERENCE TO RELATED APPLICATIONS

This application claims the benefit of U.S. Provisional Application Ser. No. 60/052474, filed Jul. 14, 1997. Cross reference is made to my U.S. patent application Ser. No. 09/114,367, filed Jul. 14, 1998, now U.S. Pat. No. 5,937,971, which is entitled "Convertible Lift Mechanism" and is filed concurrently herewith.

FIELD OF THE INVENTION

The present invention relates generally to the field of vertical lifts, and in particular, lift mechanisms that convert to stairs.

BACKGROUND OF THE INVENTION

Stairways employed in buildings and other structures present difficulties to non-ambulatory individuals. For example, a non-ambulatory individual confined to a personal vehicle such as a wheelchair cannot easily negotiate common stairwells. To accommodate such individuals, separate elevator lifts, moving chair arrangements, or ramps are often provided. In stair structures extending a vertical distance that is less than a building story, such as those typically used near the entrance to a building, a separate elevator lift is not always practical, particularly in outdoor environments. In such cases, separate ramps or moving chair arrangements may be provided which facilitate vertical travel by a personal vehicle.

One drawback to the use of a separate ramp to provide personal vehicle access to elevated surfaces is that suitable ramps consume relatively large amounts of space. As a result, existing buildings must often be substantially altered to accommodate the installation of a ramp. In many circumstances, space constraints surrounding the building make installation of a ramp impossible.

Moving chair arrangements offer a solution in such low rise environments. Moving chair arrangements comprise a chair that slides diagonally up and down the stair way. Such arrangements require that the personal vehicle be separately transported up or down the stairway. Because personal vehicles can be quite heavy, separate transport of the personal vehicle can be difficult. Moreover, the movable chair itself, when not in use, nevertheless occupies stairway space and dictates the appearance of the staircase.

Separate vertical wheelchair lifts have also been employed for such low rise environments for use in situations in which there is inadequate room for an access ramp. Such devices, however, while consuming less space than a ramp, nevertheless consume valuable access space and dictate architectural parameters. Moreover, separate wheelchair lifts may be impossible to implement in hallways or other narrow environments.

In an attempt to address some of the concerns of the separate vertical lift, lifts have been developed that cooperate with a staircase to provide a lift that fits within a hallway or narrow environment. For example, U.S. Pat. No. 4,457,402 to Del Vecchio et al. shows a lift that is disposed directly in front of a low rise staircase that extends from a lower surface to an upper surface. The lift provides vertical transport of wheelchairs from the lower surface to the level of the upper surface. When the lift rises, the stairs collapse upward to form a bridge platform that allows travel from the lift platform over the area normally occupied by the staircase to the destination upper surface.

Another proposed design of a lift that may be located in a hallway is found in U.S. Pat. No. 5,234,078 to Smith. In the Smith patent, the lift platform is normally located on the upper surface directly behind the ascending stairs. In other words, the lift platform forms a portion of the upper surface. The lift platform provides transport between the upper surface and the lower surface through vertical movement. When the lift platform lowers to the level of the lower surface, the stairs collapse so that they too are substantially on the level of the lower surface. When the lift platforms rises to the level of the upper surface, the stairs reconfigure into a staircase.

A drawback of the designs found in the Del Vecchio et al. and Smith patents discussed above is that they require space equivalent to the area of the lift platform either completely in front of or completely behind the staircase. In some cases, such area is not available. Moreover, because the lift platform is located completely outside the footprint of the staircase, the lift platform creates a potentially displeasing architectural discontinuity with the surface at which it normally rests while not in operation. For example, as shown in FIG. 1 of the Smith patent, the lift structure requires special wall and floor structures that create visible discontinuities along the floor and wall. Likewise, the lift shown in FIG. 1 of the Del Vecchio et al. patent undesirable creates a plainly visible discontinuity along the intersection of the platform and lower (ground) surface. Such discontinuities significantly affect the appearance of an architectural structure.

There exists a need, therefore, for a lift structure for providing access to personal vehicles between a lower surface and an upper surface that has reduced impact on the architectural and/or design aspects of a structure, and may be employed in structures with space constraints.

SUMMARY OF THE INVENTION

The present invention fulfills the above need, as well as others, by providing a convertible lift mechanism that employs a conversion stair that functions as a stair in one configuration and as a lift platform in another configuration. By employing a stair that converts into a lift platform, the lift platform need not be implemented as a totally separate structure that both occupies additional space and impinges upon the architectural integrity of a structure. Instead, the convertible lift mechanism of the present invention includes a lift platform that occupies space that is already occupied by the staircase, thus requiring little or no additional space. Accordingly, the architectural integrity of the structure is left substantially intact.

In accordance with a first embodiment of the present invention, there is provided a convertible lift mechanism for lifting a person or an object from a first surface to a vertically displaced second surface. The convertible lift mechanism includes a source of motive force and a conversion stair having a first configuration and a second configuration. The conversion stair in the first configuration is substantially stationary and has a substantially horizontal surface that is horizontally positioned apart or away from the second surface and vertically positioned between the first surface and the second surface. The conversion stair in the second configuration has a substantially horizontal lifting surface movable between a first position and a second position. The first position is defined by a first horizontal position and a first vertical level, the first vertical level being approximately level with the first surface. The second position is defined by the first horizontal position and a second vertical level, the second vertical level being approximately level with the second surface. The convertible lift mechanism further includes a scissors lift linkage that is operably coupled to the source of motive force and the conversion stair. The scissors lift linkage causes the conversion stair to move between the first vertical level and the second vertical level in response to motive force generated by the source of motive force.

The use of the conversion stair that has two configuration affords the ability to provide alternative transport means at a stairway while requiring little or no additional space. Moreover, the scissors lift linkage provides an inexpensive and structurally stable means for translating the lift surface between an upper surface and a lower surface.

Another advantage of the present invention relates to retractable stairs, which may optionally be provided. The retractable stairs allow for stairs in addition to the conversion stair to accommodate displacements between the upper and lower surface that require more than two traditional stairs.

The above features and advantages, as well as others, will become more readily apparent to those of ordinary skill in the art by reference to the following detailed description and accompanying drawings.

DETAILED DESCRIPTION

Figure 1:
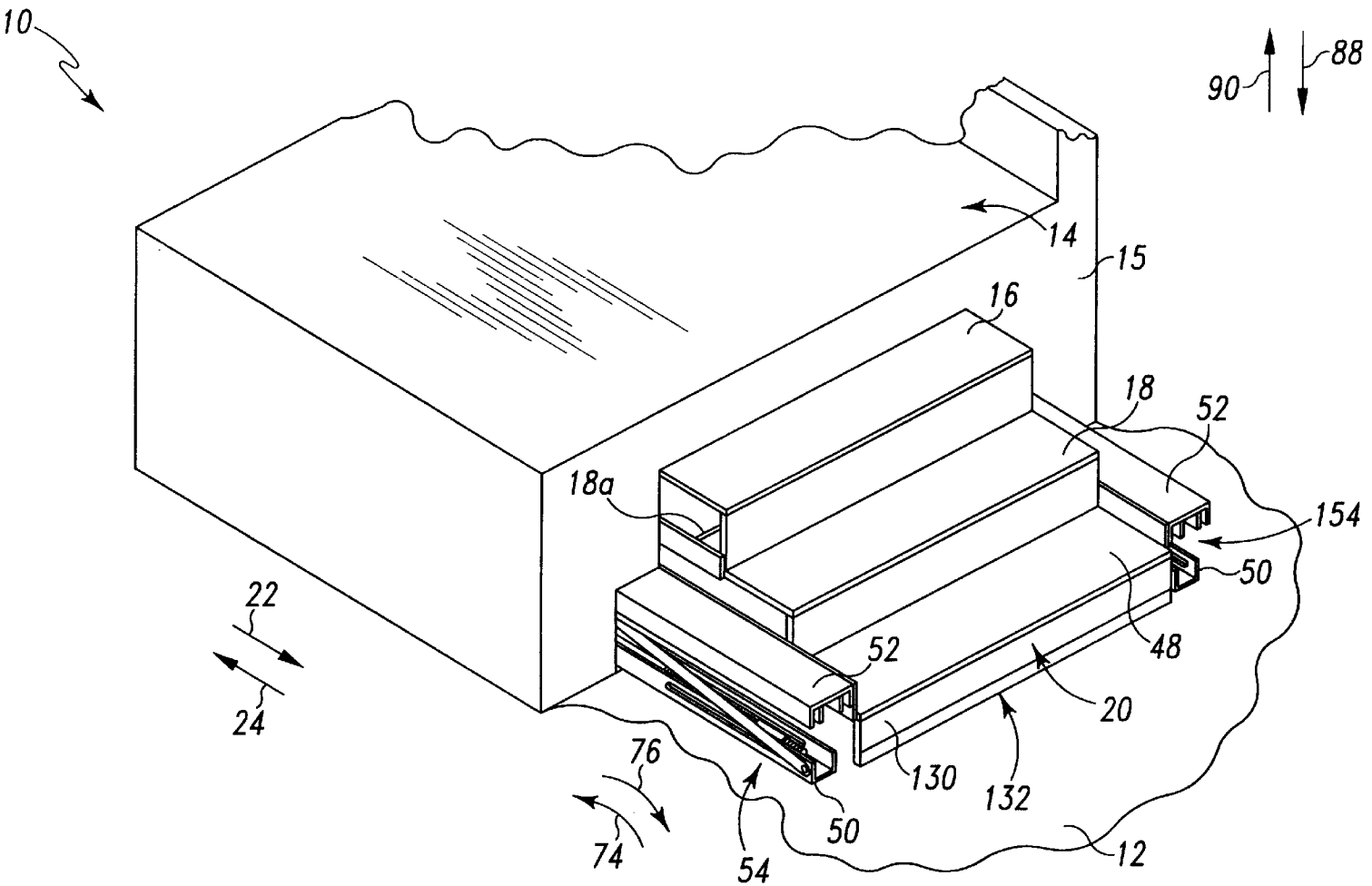
FIG. 1 is a perspective view of a convertible lift mechanism with a conversion stair in a first configuration which incorporates the features of the present invention therein.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Figure 1A:
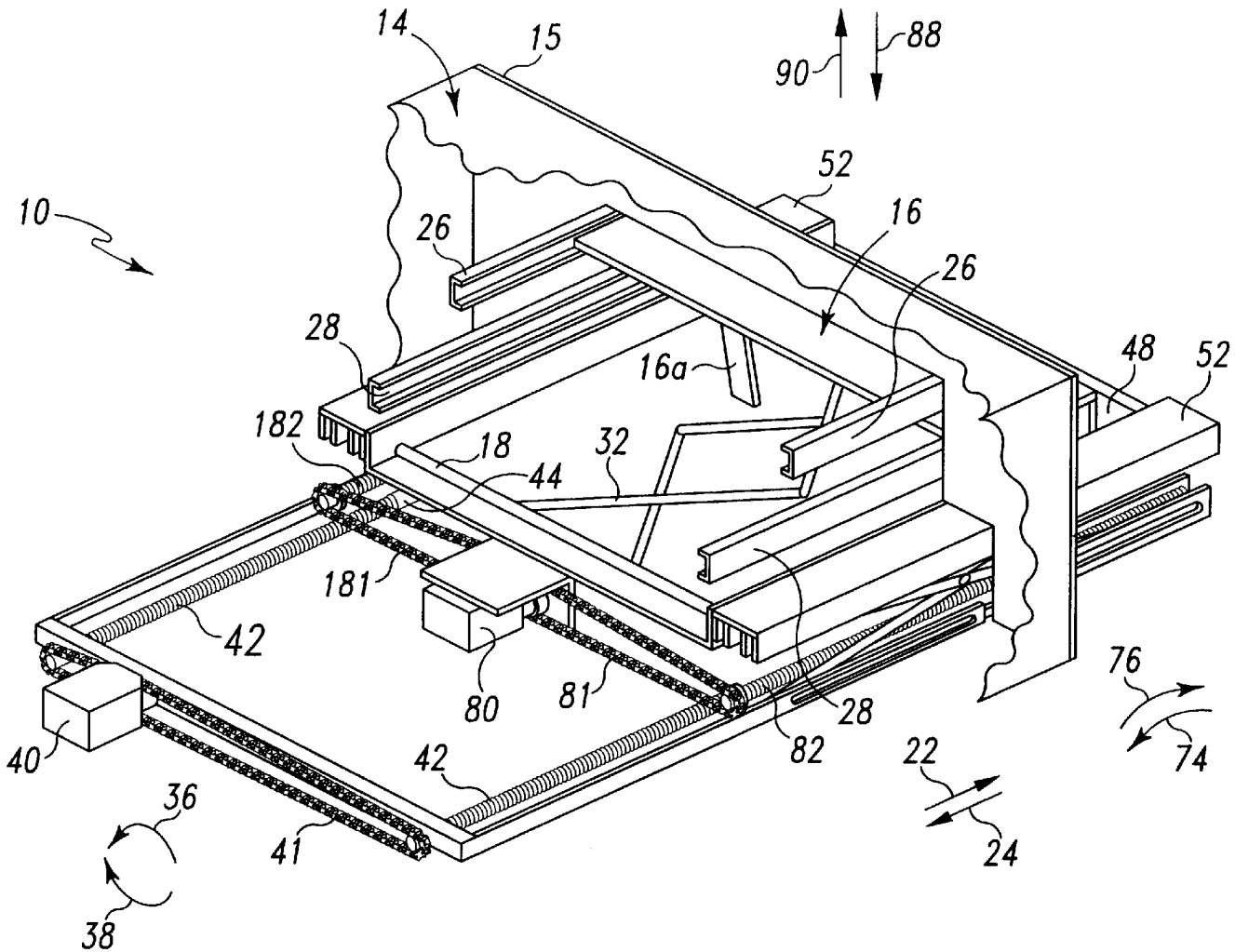
FIG. 1A is a rear perspective view of the convertible lift mechanism of FIG. 1.

FIGS. 1 and 1A show an exemplary embodiment of a convertible lift mechanism 10 according to the present invention that enables travel from a first or lower surface 12 and a second or upper surface 14. The convertible lift mechanism 10 includes a first retractable stair 16, a second retractable stair 18, a conversion stair 20, a source of motive power in the form of a motor 80, and scissor lift linkages 54 and 154.

In general, the convertible lift mechanism 10 has a first configuration and a second configuration. In the first configuration, as shown in FIGS. 1 and 1A and discussed in further detail below, the convertible lift mechanism operates as a stairway between the lower surface 12 and upper surface 14. In the second configuration, the convertible lift mechanism 10 operates as a vertical lift between the lower surface 12 and the upper surface 14.

Also shown in FIGS. 1 and 1A is a vertical wall 15, which extends from the lower surface 12 to the upper surface 14. It is noted that FIG. 1A is a cutaway perspective view in which the upper surface 14 is only shown in part in order to reveal structural features of the convertible lift mechanism 10 that are located under the upper surface 14.

In general, the conversion stair 20 includes a substantially horizontal surface 48 and a convertible riser 130. As will be discussed more fully below, a portion of the surface 48 operates as a stepping surface of a stair when the convertible lift mechanism 10 is in the first configuration (sec FIG. 1). As with any stair, the portion of the surface 48 that operates as a stepping surface extends outward (and is horizontally positioned apart from) the upper surface 14, and is positioned vertically between the lower surface 12 and the upper surface 14. In the second configuration, however, the entire surface 48 operates as a lift platform that moves between a first position and a second position. The first position is at a vertical level that is approximately level with (i.e., within two inches of) the lower surface 12. The second position is more or less directly above the first position and is at a vertical level that is approximately level with the upper surface. Further details regarding the second configuration are provided further below in connection with FIGS. 3, 4, 5 and 5A.

Each of the first and second retracting stairs 16 and 18 includes a stepping surface and a riser, as would any stair. Each retracting stair 16 and 18, however, is also movable between an extended position that corresponds to the first configuration of the convertible lift mechanism 10 (see, e.g., FIG. 1) and a retracted position that corresponds to the second configuration (see, e.g. FIG. 3). In the extended position, the stepping surfaces of the retracting stairs 16 and 18 are disposed outward of the vertical wall to form ascending stairs. By contrast, in the retracted position, the stepping surfaces of the retracting stairs 16 and 18 are stowed completely underneath the upper surface 14 to permit vertical travel of the conversion stair 20 between the lower surface 12 and the upper surface 14. A more detailed description of the structure and operation of retracting stairs 16 and 18 is provided further below.

The source of motive power may suitably comprise an electric motor, such as the lift motor 80 (shown in FIG. 1A). However, alternative embodiments may employ alternative sources of motive power, such as, for example, a hydraulic lift system power source, a pneumatic piston system power source, and the like. Those of ordinary skill in the art may readily determine the appropriate type of motive power source for their particular implementation.

Each of the scissor lift linkages 54 and 154 is a linkage assembly that translates the motive force form the lift motor 80 to the conversion stair 20 to facilitate vertical movement of the surface 48 between the lower surface 12 and the upper surface 14. Further detail regarding the structure of the scissor lift linkages 54 and 154 is provided below in connection with FIGS. 3, 4, 5 and 5A.

Referring now specifically to FIG. 1A, the first retracting stair 16 is slidingly secured to the building or facility under the upper surface 14 such that the first retracting stair 16 can move horizontally between the retracted position and the extended position. To this end, the first retracting stair 16 includes a plurality of wheels, not shown, which are received by a first set of rails 26. The first set of rails 26 are affixed to building or facility under the upper surface 14. The first retracting stair 16 moves via the plurality of wheels along the set of rails 26 in the general directions of arrows 22 and 24. The first retracting stair 16 also includes a vertical member 16*a* disposed vertically downward from the rear of its stepping surface.

Similarly, the second retracting stair 18 is also slidingly secured to the building or facility under the upper surface 14 such that the second retracting stair 18 can move horizontally between its extended position and its retracted position. To this end, the second retracting stair 16 also includes a plurality of wheels, not shown, which are received by a second set of rails 28 that are, in turn, affixed to the building or facility under the upper surface 14. The second retracting stair 18 includes a lip 18*a* extending vertically upward from the back edge of the stepping surface thereof. The lip 18*a* is advantageously configured to engage the vertical member 16*a* during retraction of the second retracting stair 18 and to engage the riser of the first retracting stair 16 during extension of the second retracting stair 18.

The convertible lift mechanism 10 further includes a retraction motor, not shown, that is mounted to the second retractable stair 18 underneath its stepping surface. The retraction motor and operatively coupled to the second retractable stair 18 so as to advance the second retractable stair 18 in the general directions of arrows 22 and 24. In particular, a retraction linkage 32 (shown in FIG. 1A) is coupled to the output shaft of the retraction motor through a lead screw or the like, not shown. The retraction linkage is also fixedly coupled at one end to a stationary member at the rear of the second retractable stair 18.

Referring again to the conversion stair 20, the convertible lift mechanism 10 further includes a positioning motor 40 that controls the horizontal location of the conversion stair 20. The horizontal location of the conversion stair 20 in the embodiment described herein differs in the first configuration and the second configuration. In particular, in order to provide an appropriately proportioned staircase when in the first configuration, the conversion stair 20 must be partially retracted such that a portion of the surface 48 is disposed underneath the upper surface 14. As will be discussed below, the conversion stair 20 in the second configuration is fully extended such that the entire surface 48 is outward of the vertical wall 15.

To this end, the positioning motor 40 is secured underneath the upper surface 14 and is operatively coupled to the conversion stair 20 so as to advance the conversion stair 20 in the general directions of arrows 22 and 24. To this end, a pair of positioning shafts 42 (shown in FIG. 1A) are coupled to the output shaft of the positioning motor 40 by a chain 41. Each of the positioning shafts 42 includes a lead screw and thus has a set of threads defined on the outer surface thereof. The conversion stair 20 includes two positioning nuts 44, each of which is threadingly engaged to the threads of each of the positioning shafts 42. The conversion stair 20 further includes as set of wheels (not shown) that engage the lower surface 12. The wheels facilitate translation of the conversion stair 20 along the first surface 12 in the general direction of arrows 22 and 24.

Figure 3:
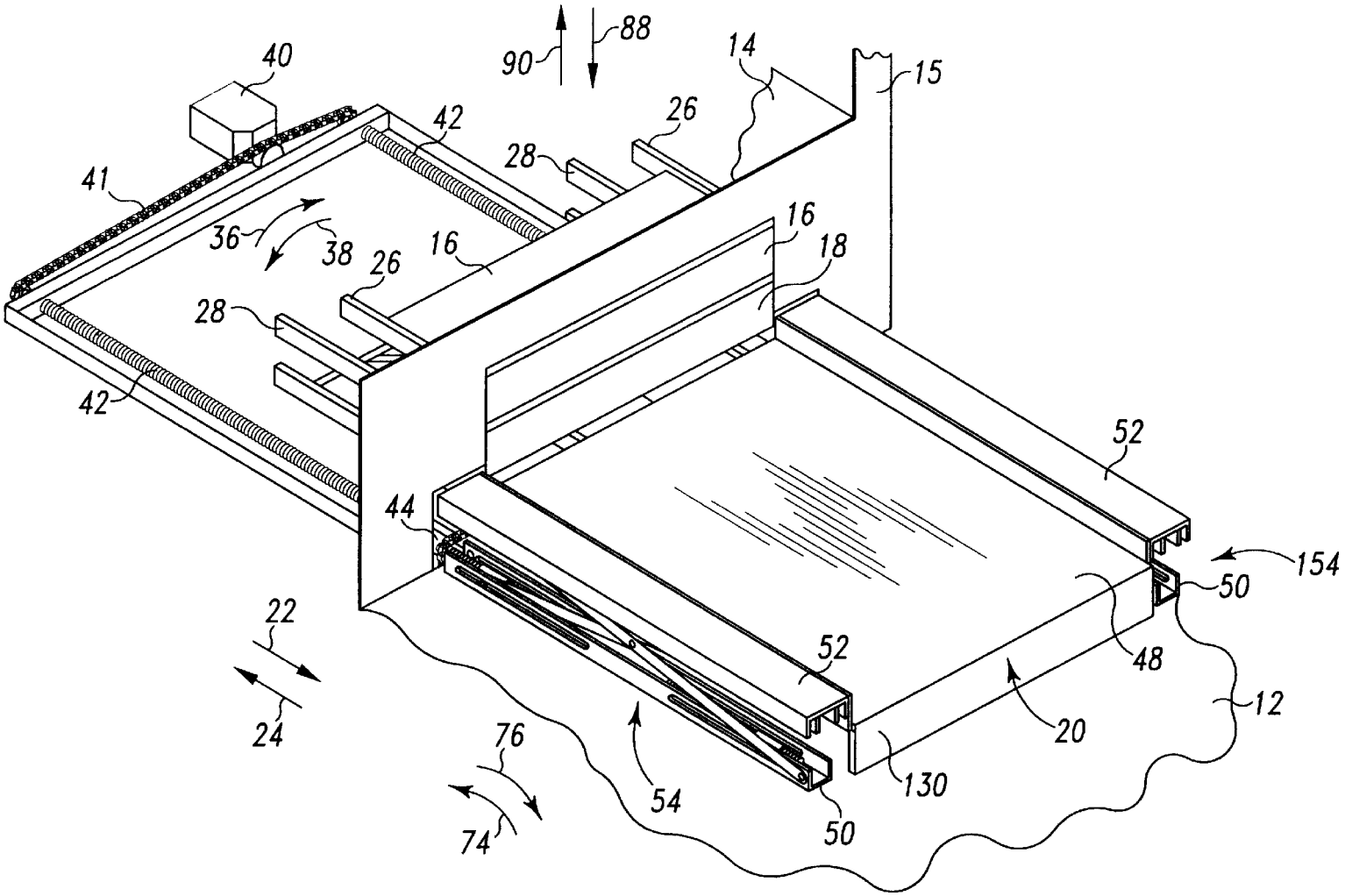
FIG. 3 is a perspective view of the convertible lift mechanism of FIG. 1 showing the conversion stair in a fully extended position.
Figure 4:
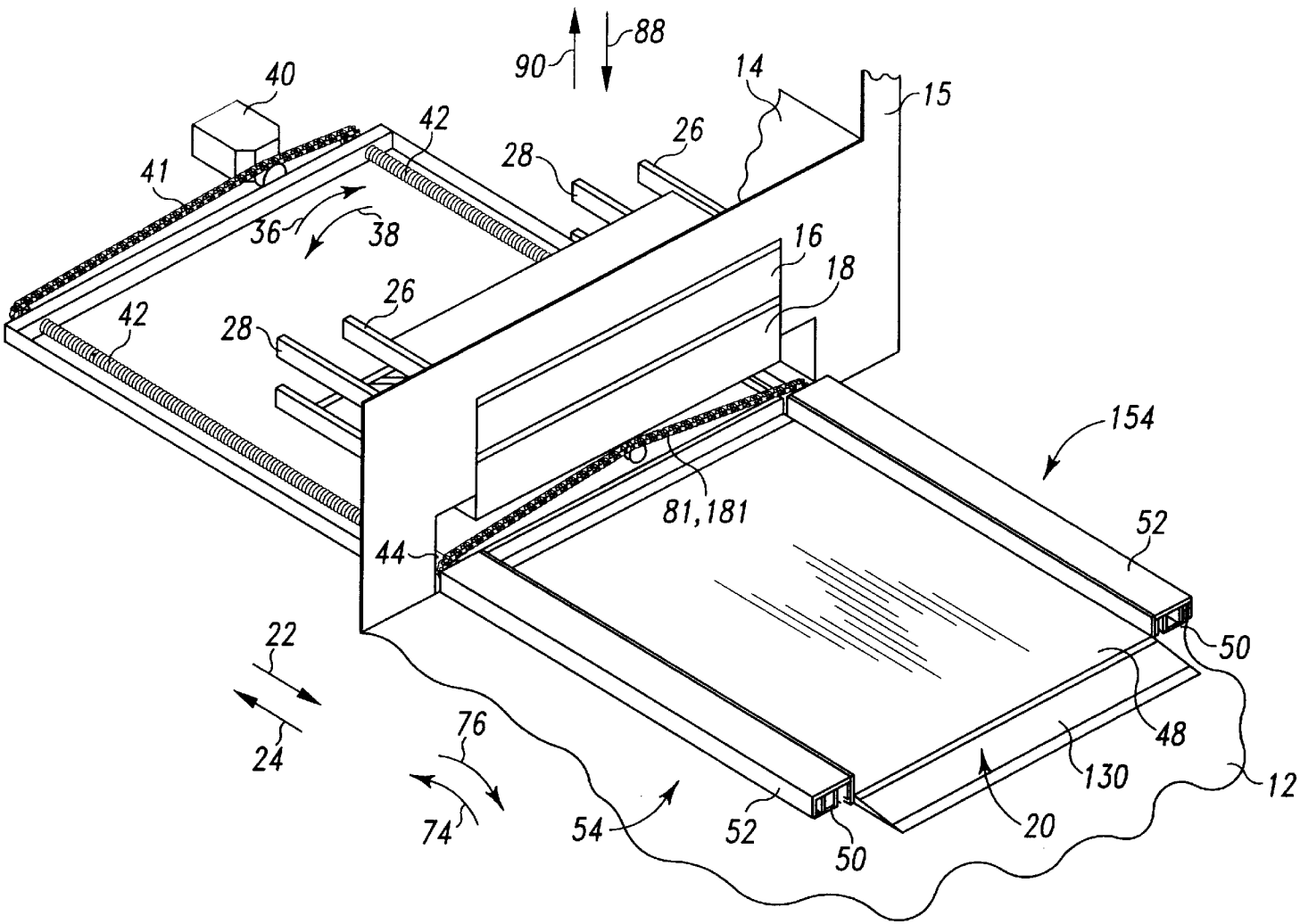
FIG. 4 is a perspective view of the convertible lift mechanism of FIG. 1 showing the horizontal lift surface of the conversion stair in the first position.
Figure 5:
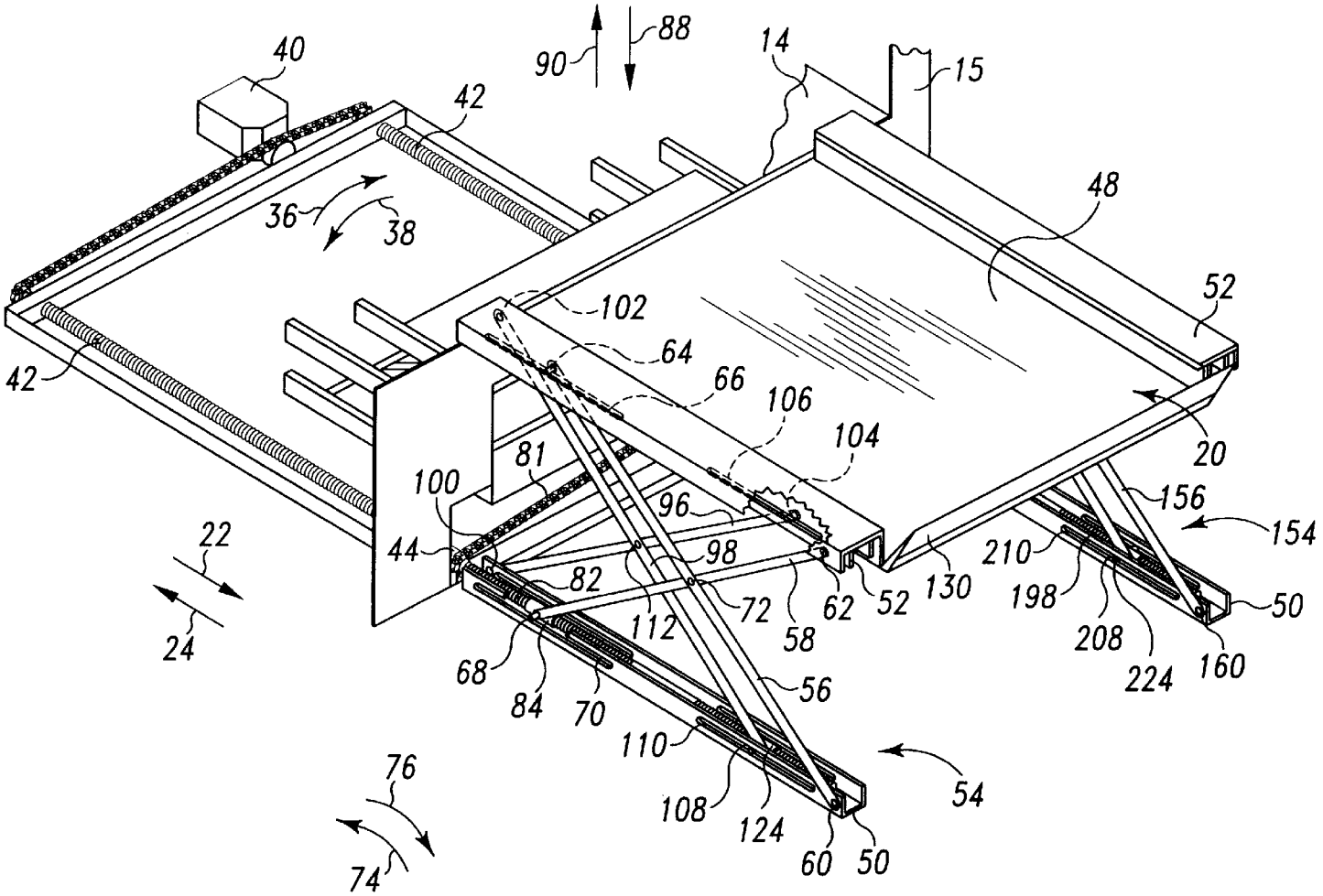
FIG. 5 is a perspective view of the convertible lift mechanism of FIG. 1 showing a horizontal lift surface in the second position.

FIGS. 3, 4, and 5 show the convertible lift mechanism wherein the conversion stair 20 in various stages of operation within the second configuration. As a result, certain structures of the convertible lift mechanism 10 are more clearly revealed in FIGS. 3 through 5. Accordingly, reference is now made generally to FIGS. 3 4, 5 and 5A to describe further structural details of the present embodiment.

The conversion stair 20 includes two upper supports 52. Each of the upper supports 52 comprises a beam having a U-shaped cross section. The upper supports 52 co-extend with and are secured to each side of the surface 48. The convertible lift mechanism 10 also includes two lower frame members 50 disposed below each of the upper supports 52. The first scissor lift linkage 54 is disposed between one of the upper supports 52 and a corresponding one of the lower frame members 50. The second scissor lift linkage 154 is disposed between the other upper support 52 and the corresponding other lower frame member 50.

In the exemplary embodiment described herein, the first scissor lift linkage 54 includes a first front diagonal linkage 56 and a second front diagonal linkage 58. A first end of the first front diagonal linkage 56 is pivotally coupled to the lower frame member 50 by a pin 60. The pin 60 is fixedly coupled to the lower frame member 50. The other end of the first front diagonal linkage 56 is pivotally coupled to a pin 64 which is received in a slot 66 defined in the upper support 52. In contrast to the pin 60, the pin 64 is slidably coupled to the upper support 52 such that the first front diagonal linkage 56 can translate in the general direction of arrows 22 and 24 relative to the upper support 52.

Similarly, the second front diagonal linkage 58 is pivotally coupled to the upper frame 52 by a pin 62. The pin 62 is fixedly secured to the upper frame. The other end of the second front diagonal linkage 58 is pivotally coupled to a pin 68 which is received in a slot 70 defined in the lower frame member 50 such that the pin 68 and the second front diagonal linkage 58 can translate in the general direction of arrows 22 and 24.

The first front diagonal linkage 56 and the second front diagonal linkage 58 are pivotally coupled to one another by a pin 72 such that the second front diagonal linkage 58 can rotate relative to the first front diagonal linkage 56 in the general directions of arrows 74 and 76.

The second front diagonal linkage 58 is also operably coupled to the lift motor 80. In particular, the lift motor 80, which is secured to the lower frame members 50, is operatively coupled by a chain 81 to two lift shafts 82 and 182. Each of the lift shafts 82 and 182 comprises a lead screw and thus has a set of threads defined on the outer surface thereof. The second front diagonal linkage 58 includes or is secured to a lift nut 84 which is threadingly engaged to the threads of the lift shaft 82.

The first scissor lift linkage 54 further includes first rear diagonal linkage 96 and a second rear diagonal linkage 98. A first end of the first rear diagonal linkage 96 is pivotally coupled to the lower frame member 50 by a pin 100. The other end of the first rear diagonal linkage 96 is pivotally coupled to a pin 104. The pin 104 is slidably coupled to the upper support 52 within a slot 106 defined therein such that the first rear diagonal linkage 96 can translate in the general direction of arrows 22 and 24.

Likewise, the second rear diagonal linkage 98 is pivotally coupled to the upper support 52 by a pin 102. The other end of the second rear diagonal linkage 98 is pivotally coupled to a pin 108 which is recieved in a slot 110 that is defined in the lower frame member 50, such that the second rear diagonal linkage 98 can translate in the general direction of arrows 22 and 24 relative to the lower frame member 50. The first rear diagonal linkage 96 and the second rear diagonal linkage 98 are pivotally coupled to each other by a pin 112 such that the second rear diagonal linkage 98 can rotate relative to the first rear diagonal linkage 96 in the general directions of arrows 74 and 76.

A lift nut 124 is threadingly engaged to the threads of the lift shaft 82 and secured to the pin 108 of the second rear diagonal linkage 98. It should be noted that the lift nut 124 is threaded in the opposite direction of the threads of the lift nut 84 of the second front diagonal linkage 58. Accordingly, as the lift nut 84 advances in the general direction of arrow 22, the lift nut 124 advances in the general direction of arrow 24 whereas as the lift nut 84 advances in the general direction of arrow 24, the lift nut 124 advances in the general direction of arrow 22.

As the lift motor 80 rotates the lift shaft 82 in the general direction of arrow 36, the lift nut 124 advances along the lift shaft 82 in the general direction of arrow 24 so as to urge the lift nut 124 and the pin 108 in the general direction of arrow 24.

Figure 5A:
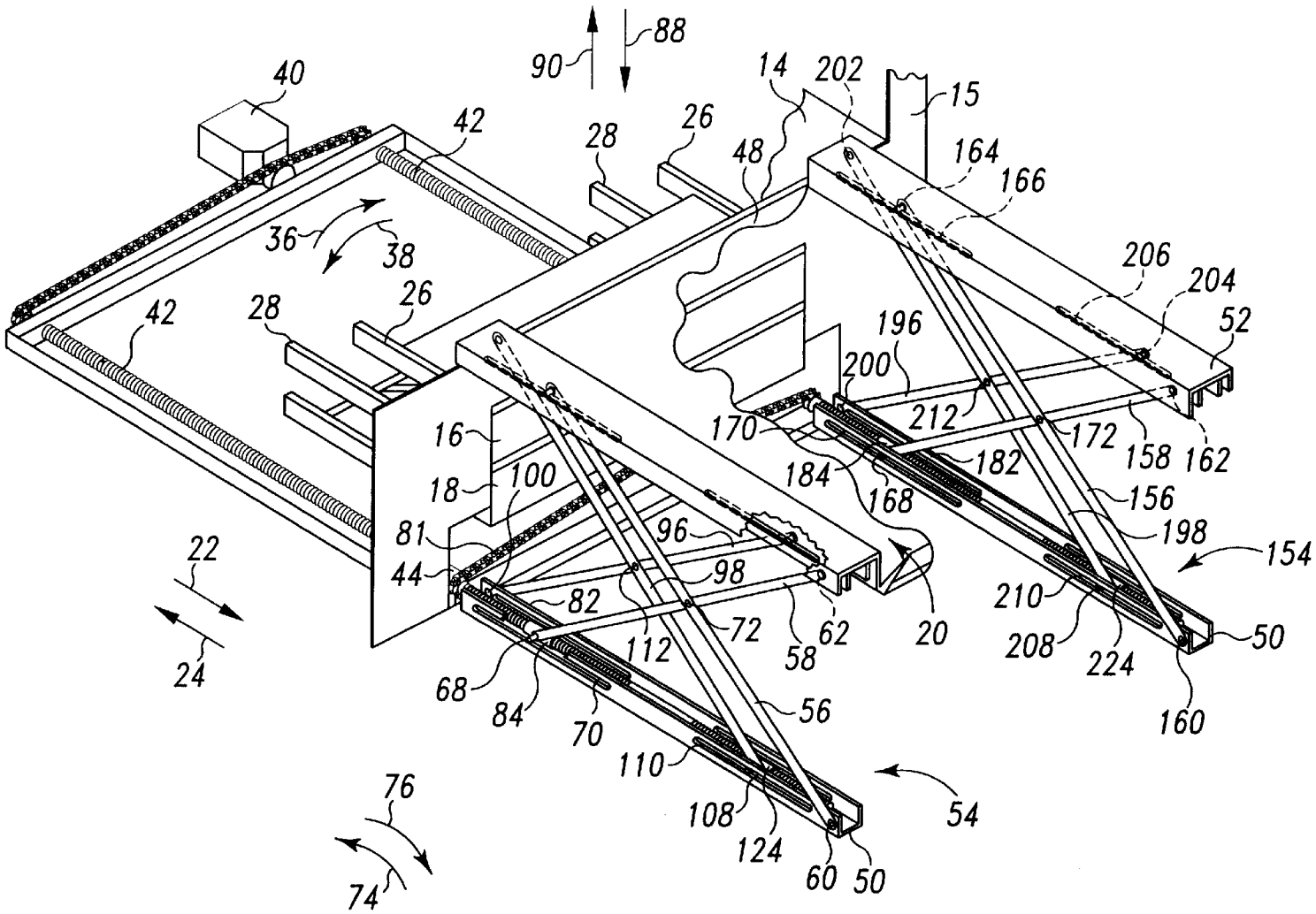
FIG. 5A is a view similar to FIG. 5, but having a portion of the horizontal lift surface cut away for clarity of description.

Referring now specifically to FIG. 5A, the second scissor lift linkage 154 is configured to cooperate with the first scissor lift linkage 54 to translate the motive force of the lift motor 80 to vertical travel of the conversion stair 20. To accomplish this, the second scissor lift linkage 154 further includes, among other things, a third front diagonal linkage 156 and a fourth front diagonal linkage 158.

A first end of the third front diagonal linkage 156 is pivotally coupled to the lower frame member 50 by a pin 160. The other end of the third front diagonal linkage 156 is pivotally coupled to a pin 164 which is received in a slot 166 defined in the upper support 52 such that the third front diagonal linkage 156 can translate in the general direction of arrows 22 and 24.

Likewise, the fourth front diagonal linkage 158 is pivotally coupled to the upper support 52 by a pin 162. The other end of the fourth front diagonal linkage 158 is pivotally coupled to a pin 168 which is received in a slot 170 that is defined in the lower frame member 50 such that the fourth front diagonal linkage 158 can translate in the general direction of arrows 22 and 24. The third front diagonal linkage 156 and the fourth front diagonal linkage 158 are pivotally coupled to each other by a pin 172 such that the fourth front diagonal linkage 158 can pivotally move relative to the third front diagonal linkage 156 in the general directions of arrows 74 and 76.

The fourth front diagonal linkage 158 is also operable coupled to the lift motor 80. In particular, the lift motor 80 is operatively coupled by a chain 181 to the lift shaft 182 (shown in FIG. 1A) which comprises a lead screw and thus has a set of threads defined on the outer surface thereof. A lift nut 184 is threadingly engaged to the threads of the lift shaft 182 and is secured to the pin 168 of the fourth front diagonal linkage 158.

The second scissor lift linkage 154 further includes third rear diagonal linkage 196 and a fourth rear diagonal linkage 198. A first end of the third rear diagonal linkage 196 is pivotally coupled to the lower frame member 50 by a pin 200. The other end of the third rear diagonal linkage 196 is pivotally coupled to a pin 204 which is received in a slot 206 that is defined in the upper support 52 such that the third rear diagonal linkage 196 can translate in the general direction of arrows 22 and 24.

Similarly, the fourth rear diagonal linkage 198 is pivotally coupled to the upper support 52 by a pin 202. The other end of the fourth rear diagonal linkage 198 is pivotally coupled to a pin 208 which is recieved in a slot 210 that is defined in the lower frame member 50 such that the fourth rear diagonal linkage 198 can translate in the general direction of arrows 22 and 24. The third rear diagonal linkage 196 is pivotally coupled to the fourth rear diagonal linkage 198 by a pin 212.

A lift nut 224 is threadingly engaged to the threads of the lift shaft 182 and secured to the pin 208 of the fourth rear diagonal linkage 198. It should be noted that the lift nut 224 is threaded in the opposite direction than the lift nut 184 such that as the lift nut 184 advances in the general direction of arrow 22, the lift nut 224 advances in the general direction of arrow 24 whereas as the lift nut 184 advances in the general direction of arrow 24, the lift nut 224 advances in the general direction of arrow 22.

The convertible lift mechanism 10 further includes a convertible riser 130 pivotally secured to the upper support 52 support such that the convertible riser 130 can rotate in the general direction of arrows 74 and 76 relative to the upper support 52. The convertible riser 130 has three modes of operation. In the first mode of operation, the convertible riser 130 functions as a step riser. In the second mode of operation, the convertible riser 130 functions as a vehicle ramp. In the third mode of operation, the convertible riser 130 functions as a safety guard.

When the conversion stair 20 is in the first configuration, i.e. the conversion stair 20 is being used as a stair, the convertible riser 130 is in a first mode of operation whereby the convertible riser 130 is positioned such that an end 132 of the convertible riser 130 is oriented downwardly in the general direction of arrow 88 from the upper support 52 as shown in FIGS. 1, 1A, 2 and 6A. So oriented, the convertible riser 130 acts as a step riser to prevent a persons foot from advancing too far in the general direction of arrow 24.

Figure 6C:
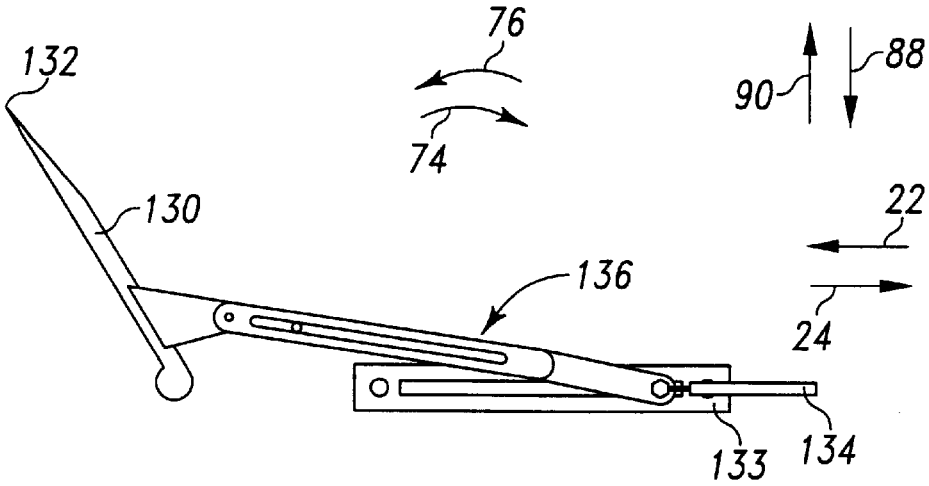
FIG. 6C a view similar to FIG. 6A, but showing the convertible riser in a third mode of operation.
Figure 6B:
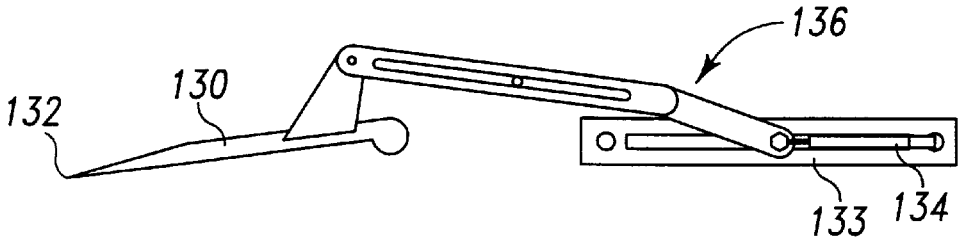
FIG. 6B a view similar to FIG. 6A, but showing the convertible riser in a second mode of operation.

When the conversion stair 20 is in the second configuration and the horizontal lifting surface 48 is approximately level with the lower surface 12, the convertible riser 130 is positioned in a second mode of operation shown in FIGS. 4 and 6B. In the second mode of operation, the convertible riser 130 extends substantially horizontally outward. When the convertible riser 130 is in the second mode of operation, the convertible riser 130 functions as a ramp between the lower surface 12 and the horizontal lifting surface 48 there by allowing a wheelchair or other personal vehicle to move between the first surface 12 to the horizontal lifting surface 48.

The third mode of operation shown in FIGS. 5, 5A and 6C. In the third mode of operation, the convertible riser 130 is oriented substantially vertically in the general direction of arrow 90 from the surface 48. In the third mode of operation, the convertible riser 130 functions as a safety guard to prevent a personal vehicle from accidentally moving in the general direction of arrow 22 beyond the edge of the horizontal lifting surface 48. The convertible riser 130 is positioned in the third mode of operation at any time the conversion stair 20 is being used to move a personal vehicle between the first position to the second position.

Figure 6A:
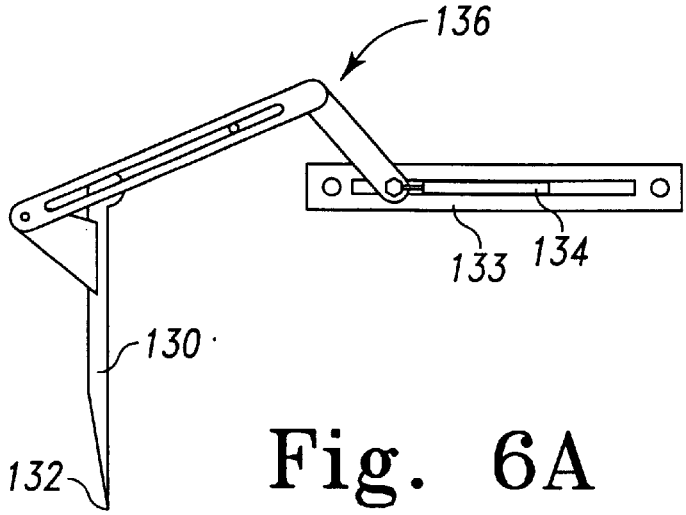
FIG. 6A a side elevation view of a convertible riser secured to the horizontal lift surface of FIG. 5 in a first mode of operation.

Referring now to FIGS. 6A, 6B, and 6C, to position the convertible riser 130, an actuator 134 is provided to move a linkage 136 relative to a support member 133 secured to the horizontal lift surface 48. In particular, as the actuator 134 is extended the farthest amount in the direction of arrow 24, the convertible riser 130 is positioned in the first mode of operation shown in FIG. 6A. When the actuator 134 is positioned in an intermediate position, the convertible riser 130 is positioned in the second mode of operation as shown in FIG. 6B. When the actuator 134 is positioned in the fully retracted position, the convertible riser 130 is positioned in the third mode of operation.

It should be appreciated that each of the lift motor 80, positioning motor 40, and retracting motor 30 may either (i) be stepper motors allow precise control over the rotation of the respective shafts, or (ii) may also include limit switches which deactivate a respective motor when the motor has moved a respective object to the desired position. Both configurations allow the precise control needed in the present invention and are well known to those skilled in the art. A control circuit, which may suitably microprocessor-based, is also included to control the operations of the various motors and activators. Those of ordinary skill in the art may readily devise a suitable control circuit.

In operation, the default configuration of the convertible lift mechanism 10 is the first configuration, shown in FIG. 1, in which the convertible lift mechanism 10 functions as a set of stairs. To transport a personal vehicle from the lower level 12 to the upper level 14, or vice versa, the conversion stair 20 must convert to its second configuration in which the convertible lift mechanism 10 can be used as a platform lift.

To convert the conversion stair 20 from the first configuration to the second configuration, the first retractable stair 16 and the second retractable stair 18 are first moved into the retracted position. To this end, the retraction motor is activated to rotate in a first direction. As the retraction motor rotates in a first direction, the retraction linkage 32 contracts. As the retraction linkage contracts 32, the second retractable stair 18 is urged in the general direction of arrow 24.

As the second retractable step 18 retracts, the lip 18*a* thereon engages the vertical member 16*a* of the first retractable step 16. Accordingly, the continued movement of the second retractable stair 18 also urges the first retractable stair 16 in the general direction of arrow 24. Once both the first retractable step 16 and the second retractable step 18 in the retracted position shown in FIG. 2, the retraction motor stops.

Thereafter, or alternatively, contemporaneously, the conversion stair 20 moves from its partially retracted position to its fully extended position. To move the conversion stair 20 from the partially retracted position (shown in FIG. 2) to the fully extended position (shown in FIG. 3), the positioning motor 40 is activated to rotate in the general direction of arrow 36.

As the positioning motor 40 rotates the positioning shafts 42 in the general direction of arrow 36, the positioning nuts 44 advance along the respective positioning shaft 42 in the general direction of arrow 22 so as to urge the conversion stair 20 in the general direction of arrow 22 which moves the conversion stair 20 from the partially retracted position to the fully extended position.

Once the conversion stair 20 is fully extended and the first retractable stair 16 and second retractable stair 18 are in the retracted position, the convertible lift mechanism 10 is in the second configuration as shown in FIG. 3.

To allow the personal vehicle to move to the horizontal lift surface 48 of the conversion stair 20, the surface 48 of the conversion stair 20 must be lowered to its first position (shown in FIG. 4) which is approximately level with the lower surface 12. It is noted that because of the physical structural limitations of the conversion stair 20, the surface 48 will typically be slightly above the lower surface 12.

To lower the horizontal lift surface 48, the lift motor 80 rotates the lift shafts 82 and 182 in the general direction of arrow 38, which lowers the upper support 52 and the surface 48 until the surface 48 is at the first position approximately level with the first surface 12.

In particular, as the lift motor 80 rotates the lift shaft 82 in the general direction of arrow 38, the lift nut 84 on the first scissor lift linkage 54 advances along the lift shaft 82 in the general direction of arrow 24 so as to urge the lift nut 84 and the pin 68 in the general direction of arrow 24. As the pin 68 is urged in the general direction of arrow 24, the second front diagonal linkage 58 pivots in the general direction of arrow 76 about the pin 72, which urges the pin 62 and thus the upper support 52 in the general direction of arrow 88.

In a similar manner, rotation of the lift shaft 82 in the general direction of arrow 38 causes the first front diagonal linkage 56 to pivot in the general direction of arrow 74 about the pin 72. Such pivotal movement urges the pin 64 and thus the upper support 52 in the general direction of arrow 88.

Contemporaneously, as the lift motor 80 rotates the lift shaft 82 in the general direction of arrow 38, the lift nut 124 of the first scissor lift linkage 54 advances along the lift shaft 82 in the general direction of arrow 22 so as to urge the lift nut 124 and the pin 108 in the general direction of arrow 22. As the pin 108 is urged in the general direction of arrow 22, the second rear diagonal linkage 98 pivots in the general direction of arrow 74 about the pin 72 which urges the pin 102 and thus the upper support 52 in the general direction of arrow 88.

In a similar manner, rotation of the lift shaft 82 in the general direction of arrow 38 causes the first rear diagonal linkage 96 to pivot in the general direction of arrow 76 about the pin 72. Such pivotal movement urges the pin 104 and thus the upper support 52 in the general direction of arrow 88.

The various linkages of the second scissor lift linkage 154 operate in an analogous manner. Thus, when the lift motor 80 rotates the lift shaft 82 in the general direction of arrow 38, the upper support 52 is lowered in the general direction of arrow 88. It should be appreciated that lowering the upper support 52 in the general direction of arrow 88 also lowers the lifting surface 48 in the general direction of arrow 88.

In addition, as the surface 48 is lowered, the convertible riser 130 is moved from a first mode of operation (shown in FIG. 3) where the convertible riser 130 functions as a step riser to a second mode of operation (shown in FIG. 4) where the convertible riser 130 functions as a ramp. To this end, the actuator 134 is partially retracted until the convertible riser 130 extends substantially horizontally outward from the surface 48.

Once the horizontal lift surface 48 reaches the first position, a personal vehicle may be advanced from the first surface 12 to the horizontal lift surface 48 in the general direction of arrow 24 via the convertible riser 130. After the personal vehicle is positioned on the surface 48, the convertible riser 130 is moved from the second mode of operation to a third mode of operation (shown in FIGS. 5 and 5A) where the convertible riser 130 functions as a safety guard to prevent the personal vehicle from advancing in the general direction of arrow 22. To this end, the actuator 134 retracts fully to cause the convertible riser 130 to extend angularly upward from the surface 48.

The convertible lift mechanism 10 then moves the lift surface 48 vertically from the lower surface 12 to the upper surface 14. To move the horizontal lift surface 48 from the lower surface 12 to the upper surface 14, the lift motor 80 is actuated to rotate the lift shafts 82 and 182 in the general direction of arrow 36, which raises the upper support 52 and the horizontal lift surface 48 until the horizontal lift surface 48 is in the second vertical level adjacent to the second surface 14.

In particular, as the lift motor 80 rotates the lift shaft 82 in the general direction of arrow 36, the lift nut 84 of the first scissor lift linkage 54 advances along the lift shaft 82 in the general direction of arrow 22 so as to urge the lift nut 84 and the pin 68 in the general direction of arrow 22. As the pin 68 is urged in the general direction of arrow 22, the second front diagonal linkage 58 pivots in the general direction of arrow 74 about the pin 72, which urges the pin 62 and thus the upper support 52 in the general direction of arrow 90. In a similar manner, rotation of the lift shaft 82 in the general direction of arrow 36 causes the first front diagonal linkage 56 to pivot in the general direction of arrow 76 about the pin 72 such pivotal movement urges the pin 68 and thus the upper support 52 in the general direction of arrow 90.

Likewise, as the lift shaft 82 rotates in the general direction of arrow 36, the lift nut 124 and the corresponding pin 108 is urged in the general direction of arrow 24. The pin 108 is urged in the general direction of arrow 24, the second rear diagonal linkage 98 pivots in the general direction of arrow 74 about the pin 72 which urges the pin 102 and thus the upper support 52 in the general direction of arrow 90. In a similar manner, rotation of the lift shaft 82 in the general direction of arrow 36 causes the first rear diagonal linkage 96 to pivot in the general direction of arrow 74 about the pin 72. Such pivotal movement urges the pin 104 and thus the upper support 52 in the general direction of arrow 90.

The second scissor lift linkage 154 operates in an analogous manner to urge the upper support 52 in the general direction of arrow 90. Thus, when the lift motor 80 rotates the lift shaft 82 in the general direction of arrow 36, the upper support 52 is raised in the general direction of arrow 90. It should be appreciated that raising the upper support 52 in the general direction of arrow 90 raises the lifting surface 48 in the general direction of arrow 90.

Once the surface 48 reaches the second position, the lift motor 80 stops. Thereafter, the personal vehicle may be advanced from the horizontal lift surface 48 to the second position or upper surface 14 to complete the transfer of the personal vehicle from the lower surface 12 to the upper surface 14.

After the transfer of the personal vehicle from the first surface 12 to the second surface 14, the conversion stair 20 must be returned to the default or first configuration so that the convertible lift mechanism 10 may again function as a stairway. To return the horizontal lift surface 48 of the conversion stair 20 to the intermediate vertical position, the horizontal lift surface 48 must be lowered to the position shown in FIG. 3. The convertible lift mechanism 10 repeats the operations described above to lower the horizontal lift surface 48 back to the intermediate position between the first position and the second position, which is shown in FIG. 2.

In addition, as the horizontal surface 48 is lowered, the convertible riser 130 is moved from the third mode of operation (shown in FIGS. 5 and 5A) where the convertible riser 130 functions as a safety guard to the first mode of operation (shown in FIG. 3) where the convertible riser 130 functions as a step riser. To this end, the activator 134 fully extends.

Figure 2:
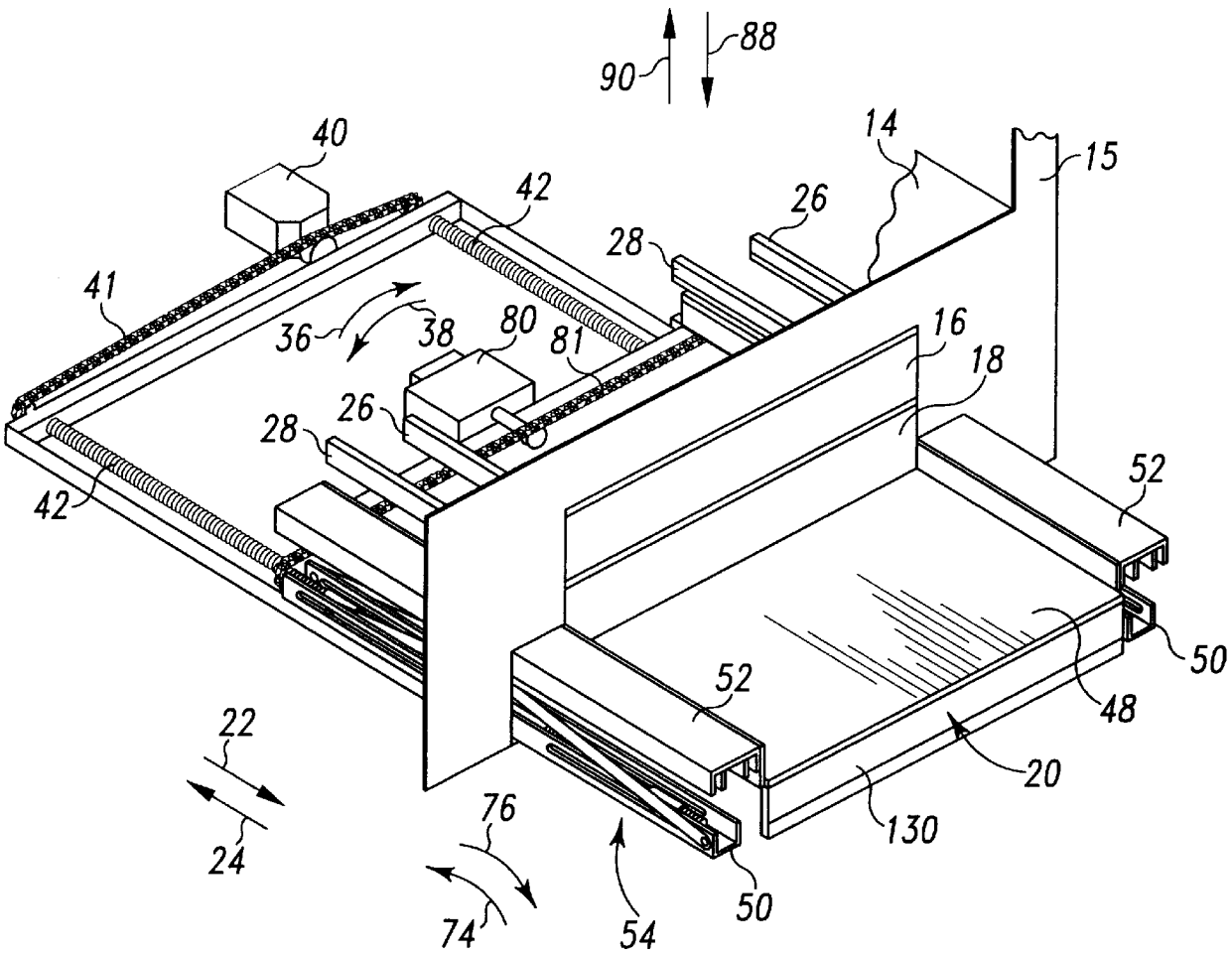
FIG. 2 is a perspective view of the convertible lift mechanism of FIG. 1 showing a first retractable stair and a second retractable stair in retracted position.

After the conversion stair 20 is vertically positioned between the lower surface 12 and the upper surface 14 in accordance with its function as a stair, the conversion stair 20 then horizontally moves to its partially retracted state as shown in FIG. 2. To move the conversion stair 20 to its partially retracted position, the positioning motor 40 is activated to cause the positioning shafts 42 to rotate in the general direction of arrow 38. As the positioning motor 40 rotates the positioning shafts 42 in the general direction of arrow 38, the positioning nuts 44 advance along the respective positioning shaft 42 in the general direction of arrow 24 so as to urge the conversion stair 20 in the general direction of arrow 24. Once the conversion stair 20 is in the partially retracted position, the positioning motor 40 stops.

Finally, to complete the conversion of the convertible lift mechanism 10 from the second configuration to the first configuration, the first retractable stair 16 and the second retractable stair 18 are moved into their extended position. To move the first retractable stair 16 and the second retractable stair 18 to the extended position, the retraction motor is activated in a second direction to cause the retraction linkage 32 to contract. As the retraction linkage 32 contracts, it urges the second retractable step 18 in the general direction of arrow 22. As the second retractable step 18 moves forward in the direction of arrow 22, the lip 18*a* engages the back of the riser of the first retractable step 16. The continued movement of the second retractable step 18 then causes similar movement of the first retractable step 16 in the direction of arrow 22. Once both the first retractable step 16 and the second retractable step 18 in the extended position shown in FIG. 1, the retraction motor stops.

Once the conversion stair 20 is positioned in its partially retracted position and the first retractable stair 16 and second retractable stair 18 are in the extended position, the convertible lift mechanism 20 is again in the first configuration. Accordingly, the convertible lift mechanism 20 is configured for use as a stairway.

It is noted that the convertible lift mechanism 10 in the second configuration can also be used to transport the personal vehicle from the upper surface 14 to the lower surface 12. To transport the personal vehicle from the upper surface 14 to the lower surface 12, the convertible lift mechanism 10 is converted from the first configuration to the second configuration as described above. In the second configuration, the convertible lift mechanism 10 then moves the surface 48 to the second position (at the upper surface 14), allows the personal vehicle to board, and then moves the surface the first position (at the lower surface 12).

Accordingly, the present invention provides an improved method and apparatus for lifting a person or an object, such as a personal vehicle, from a lower surface to an upper surface in a low-rise environment. As discussed above, prior art solutions required a substantial amount of additional space to provide facilities for non-ambulatory persons. Not only were the additional space requirements difficult and some times impossible to accommodate at all, even when accommodation was possible, the prior art devices often required alteration of the architectural structure of a facility. By contrast, the method and apparatus of the present invention employs the same footprint for both the stairs and the alternative facilities by converting one or more stairs to a lift platform. The resulting structure has the advantage of requiring substantially less space.

While the invention has been illustrated and described in detail in the drawings and foregoing description, such illustration and description is to be considered as exemplary and not restrictive in character, it being understood that only the preferred embodiment has been shown and described and that all changes and modifications that come within the spirit of the invention are desired to be protected.

I claim:

1. A convertible lift mechanism for lifting a person or an object from a first surface to a vertically displaced second surface, the convertible lift mechanism comprising:

a) a source of motive force;

b) a conversion stair having a first configuration and a second configuration, the conversion stair being substantially stationary and having a substantially horizontal surface that is positioned horizontally apart from the second surface and is positioned vertically between the first surface and the second surface when the conversion stair is in the first configuration, the conversion stair configured to move the substantially horizontal surface between a first position and a second position when the conversion stair is in the second configuration, the first position defined by a first horizontal position and a first vertical level, the first vertical level being approximately level with the first surface, and the second position defined by the first horizontal position and a second vertical level, the second vertical level being approximately level with the second surface;

c) a scissor lift linkage operably coupled to the source of motive force and the conversion stair to cause the conversion stair to move between the first position and the second position responsive to motive force generated by the source of motive force.

2. The convertible lift mechanism of claim 1 wherein a vertical wall is interposed between the first surface and the second surface, and wherein the convertible lift mechanism further comprises at least one retractable stair, each retractable stair having a substantially horizontal surface that is horizontally movable from an extended position to a retracted position.

3. The convertible lift mechanism of claim 1 further comprising a frame member disposed proximate the first surface, and wherein the scissor lift linkage further includes a first diagonal linkage pivotally coupled to a second diagonal linkage, the first diagonal linkage having a termination that slidably engages one of the conversion stair and the frame member, and second diagonal linkage having a termination that slidably engages one of the conversion stair and the frame member.

4. The convertible lift mechanism of claim 3 wherein the scissor lift linkage further comprises a third diagonal linkage pivotally coupled to a fourth diagonal linkage, the third diagonal linkage having a termination that slidably engages one of the conversion stair and the frame member, and fourth diagonal linkage having a termination that slidably engages one of the conversion stair and the frame member.

5. The convertible lift mechanism of claim 3 wherein the source of motive power comprises an electric motor.

6. The convertible lift mechanism of claim 5 wherein the scissor lift linkage includes at least one lead screw rotatably coupled to at least one of the first diagonal member and the second diagonal member.

7. The convertible lift mechanism of claim 1 wherein the source of motive power comprises an electric motor.

8. The convertible lift mechanism of claim 1 wherein:

the conversion stair further comprises a convertible riser pivotally secured the substantially horizontal surface; and the convertible riser extends substantially horizontally between the first surface and the substantially horizontal surface when the substantially horizontal surface is in the first position and the convertible riser extends angularly upward from the substantially horizontal surface when said substantially horizontal surface is in the second position.

9. A convertible lift mechanism for lifting a person or an object from a first surface to a vertically displaced second surface, the convertible lift mechanism comprising:

a) a source of motive force;

b) a conversion stair having a first configuration and a second configuration, the conversion stair being substantially stationary and having a substantially horizontal surface that is vertically positioned between the first surface and the second surface and horizontaly positioned apart from the second surface when the conversion stair is in the first configuration, the substantially horizontal surface of the conversion stair forming at least a portion of a personal vehicle lift platform movable between a first position and a second position when the conversion stair is in the second configuration, the first position defined by a first vertical level that is approximately level with the first surface, and the second position defined by a second vertical level that is approximately level with the second surface; and c) a scissor lift linkage operably coupled to the source of motive force and the conversion stair to cause the conversion stair to move between the first position and the second position responsive to motive force generated by the source of motive force.

10. The convertible lift mechanism of claim 9 wherein a vertical wall is interposed between the first surface and the second surface, and wherein the convertible lift mechanism further comprises at least one retractable stair, each retractable stair having a substantially horizontal surface that is horizontally movable from an extended position to a retracted position.

11. The convertible lift mechanism of claim 9 further comprising a frame member disposed proximate the first surface, and wherein the scissor lift linkage further includes a first diagonal linkage pivotally coupled to a second diagonal linkage, the first diagonal linkage having a termination that slidably engages one of the conversion stair and the frame member, and second diagonal linkage having a termination that slidably engages one of the conversion stair and the frame member.

12. The convertible lift mechanism of claim 11 wherein the scissor lift linkage further comprises a third diagonal linkage pivotally coupled to a fourth diagonal linkage, the third diagonal linkage having a termination that slidably engages one of the conversion stair and the frame member, and fourth diagonal linkage having a termination that slidably engages one of the conversion stair and the frame member.

13. The convertible lift mechanism of claim 11 wherein the source of motive power comprises an electric motor.

14. The convertible lift mechanism of claim 11 wherein the scissor lift linkage includes at least one lead screw rotatably coupled to at least one of the first diagonal member and the second diagonal member.

15. The convertible lift mechanism of claim 9 wherein the source of motive power comprises an electric motor.

16. A convertible lift mechanism for lifting a person or an object from a first surface to a vertically displaced second surface, the convertible lift mechanism comprising:

a) a source of motive force;

b) a frame member disposed proximate the first surface;

c) a conversion stair having a first configuration and a second configuration, the conversion stair being substantially stationary and having a substantially horizontal surface that is horizontally positioned apart from the second surface and vertically positioned between the first surface and the second surface when the conversion stair is in the first configuration, the conversion stair configured to move the substantially horizontal surface between a first position and a second position when the conversion stair is in the second configuration, the first position defined by a first horizontal position and a first vertical level, the first vertical level being approximately level with the first surface, and the second position defined by the first horizontal position and a second vertical level, the second vertical level being approximately level with the second surface; and d) a scissor lift linkage operably coupled to the source of motive force and the conversion stair to cause the conversion stair to move between the first position and the second position responsive to motive force generated by the source of motive force, the scissor lift linkage further including a first diagonal linkage pivotally coupled to a second diagonal linkage, the first diagonal linkage having a termination that slidably engages one of the conversion stair and the frame member, and a second diagonal linkage having a termination that slidably engages one of the conversion stair and the frame member.

17. The convertible lift mechanism of claim 16 wherein the scissor lift linkage further comprises a third diagonal linkage pivotally coupled to a fourth diagonal linkage, the third diagonal linkage having a termination that slidably engages one of the conversion stair and the frame member, and fourth diagonal linkage having a termination that slidably engages one of the conversion stair and the frame member.

* * * * *